US005501125A

United States Patent [19]

Roberts et al.

[11] Patent Number: 5,501,125

[45] **Date of Patent: *Mar. 26, 1996**

[54] QUICK RELEASE MECHANISM FOR TOOLS SUCH AS SOCKET WRENCHES

[75] Inventors: Peter M. Roberts, Chattanooga, Tenn.; John B. Davidson, Chicago; C. Robert Moon, Joliet, both of Ill.

[73] Assignee: Roberts Tool International (USA), Inc., Chicago, Ill.

[ * ] Notice: The term of this patent shall not extend beyond the expiration date of Pat. No. 5,233,892.

[21] Appl. No.: 284,344

[22] Filed: Aug. 2, 1994

Related U.S. Application Data

[63] Continuation-in-part of Ser. No. 50,514, Apr. 20, 1993, abandoned, which is a continuation-in-part of Ser. No. 959,215, Oct. 9, 1992, Pat. No. 5,233,892.

[51] Int. Cl.[6] ..... B25B 23/16

[52] U.S. Cl. ..... 81/177.85; 403/325; 279/82; 81/177.2

[58] Field of Search ..... 81/177.2, 177.85; 279/82, 86, 93, 94; 403/322, 328

[56] References Cited

U.S. PATENT DOCUMENTS

| | | |
|---|---|---|
| 1,569,117 | 1/1926 | Carpenter . |
| 1,660,989 | 2/1928 | Carpenter . |
| 1,775,402 | 9/1930 | Mandl . |
| 1,864,466 | 6/1932 | Peterson . |
| 2,072,463 | 3/1937 | Mims . |
| 2,108,866 | 2/1938 | Mandl . |
| 2,721,090 | 10/1955 | Kaman . |
| 2,736,562 | 2/1956 | Blackburn . |
| 3,011,794 | 12/1961 | Vaughn . |
| 3,018,866 | 1/1962 | Elliott et al. . |
| 3,069,945 | 12/1962 | Shandel . |
| 3,094,344 | 6/1963 | Varga . |
| 3,156,479 | 11/1964 | Drazick . |
| 3,167,338 | 1/1965 | Troike . |
| 3,208,318 | 9/1965 | Roberts . |
| 3,515,399 | 6/1970 | Wordsworth . |
| 3,613,221 | 10/1971 | Pronk . |
| 3,777,596 | 12/1973 | Smyers et al. . |
| 3,822,074 | 7/1974 | Welcker . |
| 3,890,051 | 6/1975 | Biek . |
| 4,367,663 | 1/1983 | Merics . |
| 4,399,722 | 8/1983 | Sardo, Jr. . |
| 4,420,995 | 12/1983 | Roberts . |
| 4,480,511 | 11/1984 | Nickipuck . |

(List continued on next page.)

FOREIGN PATENT DOCUMENTS

| | | |
|---|---|---|
| 0066710 | 12/1982 | European Pat. Off. . |
| 847209 | 10/1939 | France . |
| 2121316 | 9/1972 | Germany . |

*Primary Examiner*—James G. Smith
*Attorney, Agent, or Firm*—Willian Brinks Hofer Gilson & Lione

[57] ABSTRACT

A tool of the type having a drive stud for receiving and releasing a tool attachment includes an opening in the drive stud and a locking pin movably mounted in the opening. The opening defines upper and lower ends, and the lower end of the opening is located at a portion of the drive stud constructed for insertion into the tool attachment. The lower end of the locking pin is constructed to engage the tool attachment when the locking pin is positioned in an engaging position and to release the tool attachment when the locking pin is moved to a release position. An actuating element is movably positioned on the drive stud, and the actuating element is coupled to the locking pin to move the locking pin from the engaging to the release position as the actuating element moves along the longitudinal axis. An anti-rotation key is positioned between the actuating element and the drive stud to slide in a groove formed in either the actuating element or the drive stud and thereby to limit rotation of the actuating element and associated side loading of the locking pin. If desired, a resilient retaining element can be positioned in a recess in either the actuating element or the drive stud to limit movement of the actuating element relative to the drive stud along the longitudinal axis.

17 Claims, 5 Drawing Sheets

U.S. PATENT DOCUMENTS 4,508,005 4/1985 Herman et al. .
4,571,113 2/1986 Coren .
4,583,430 4/1986 Farley .
4,627,761 12/1986 Olson et al. .
4,699,029 10/1987 Kelly et al. .
4,817,475 4/1989 Kelly et al. .
4,836,708 6/1989 Chambers et al. .
4,848,196 7/1989 Roberts .
4,917,003 4/1990 Kollross .
4,932,293 6/1990 Goff .
4,943,182 7/1990 Hoblingre ..... 403/325 X FIG. 3
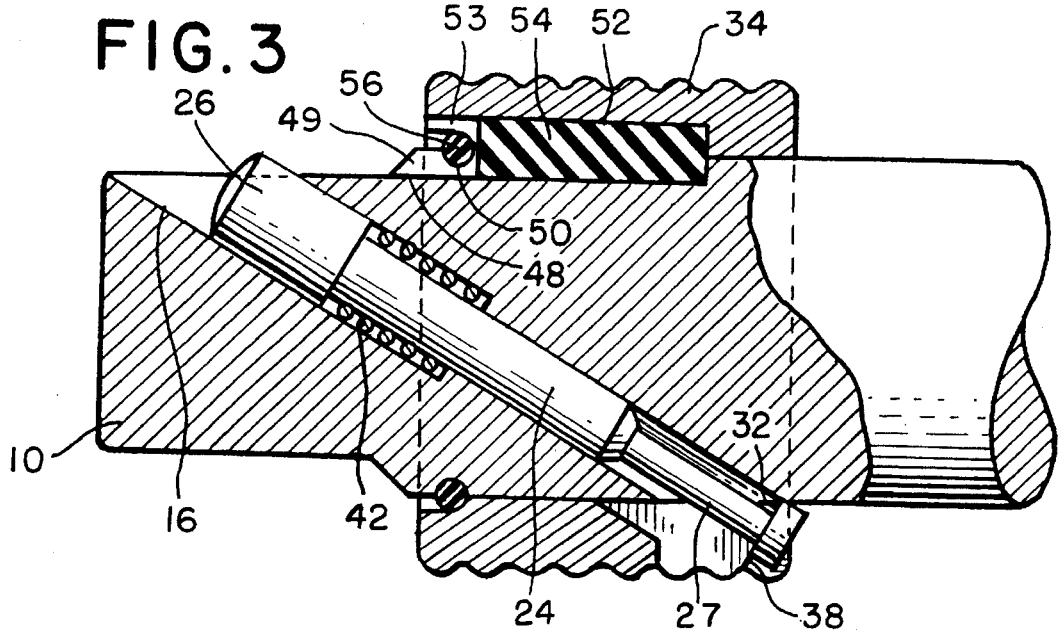
FIG. 4
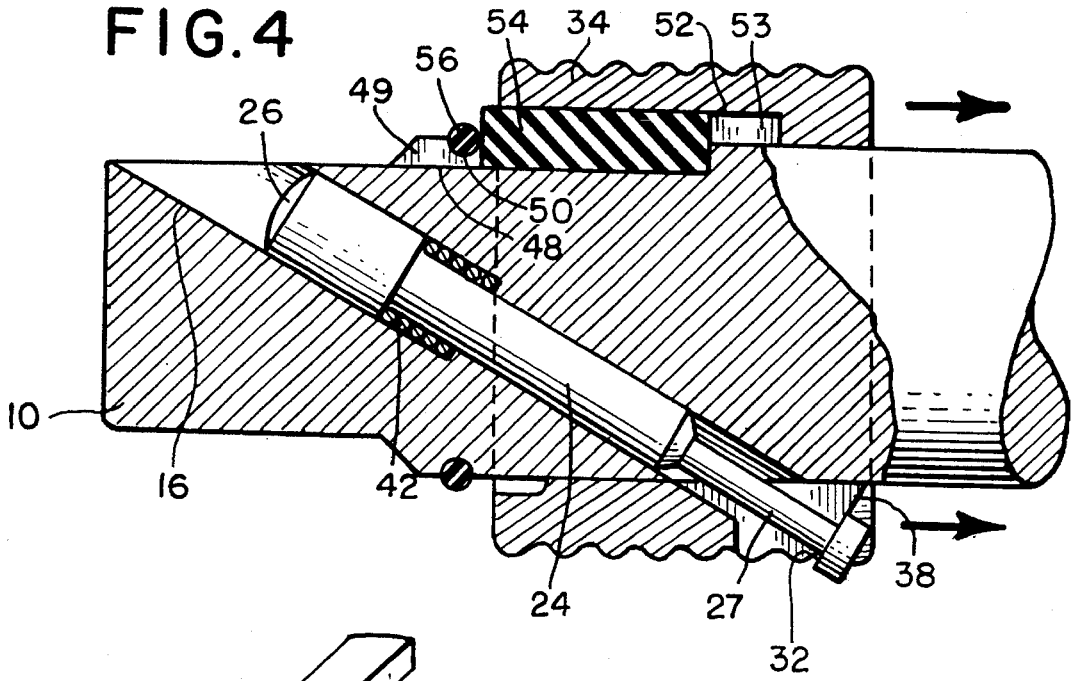
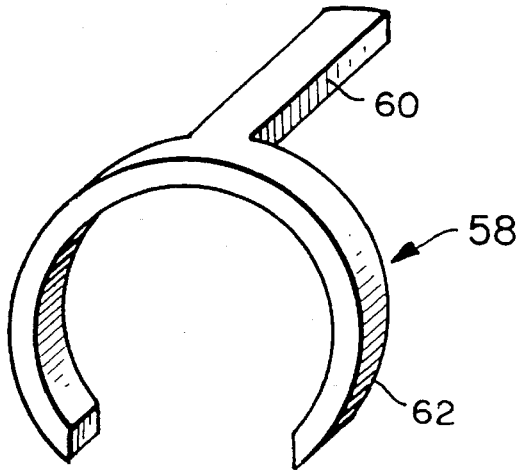
FIG. 5

QUICK RELEASE MECHANISM FOR TOOLS SUCH AS SOCKET WRENCHES

BACKGROUND TO RELATED APPLICATION

This application is a continuation-in-part of copending U.S. patent application Ser. No. 08/050,514, filed Apr. 20, 1993, abandoned, which is in turn a continuation-in-part of U.S. patent application Ser. No. 07/959,215, filed Oct. 9, 1992, now U.S. Pat. No. 5,233,892.

BACKGROUND OF THE INVENTION

This invention relates to torque transmitting tools of the type having a drive stud shaped to receive and release a tool attachment, and in particular to an improved quick release mechanism for securing and releasing a tool attachment to and releasing it from the drive stud.

My previous U.S. Pat. No. 4,848,196 discloses several quick release mechanisms for securing tool attachments such as sockets to torque transmitting tools such as wrenches. In these mechanisms the tool includes a drive stud which defines a diagonally oriented opening, and a locking pin positioned within the opening so as to move in the opening. In its engaging position, the lower end of the locking pin engages a recess in the socket so as to lock the socket positively in place on the drive stud. When the operator moves the pin in the opening, the lower end of the pin is moved out of contact with the socket, and the socket is released from the drive stud.

In the mechanism shown in FIGS. 1 through 5 of U.S. Pat. No. 4,848,196, the locking pin is held in place by an extension spring which surrounds the shaft of the drive stud. In the version shown in FIGS. 6 and 7, the extension spring is covered by a protective sleeve 70 with flanges 74, 76.

SUMMARY OF THE INVENTION

It is an object of this invention to provide an improved quick release mechanism which is simple in construction; which requires only a few, easily manufactured parts; which is rugged and reliable in use; which automatically accommodates various sockets, including those with and without recesses designed to receive a detent; which substantially eliminates any precise alignment requirements; which is readily cleaned; which presents a minimum of snagging surfaces; which is low in profile; which restrains the actuating element against rotation, and which protects the locking element from side loading.

This invention represents an improvement in a tool of the type comprising a drive stud for receiving and releasing a tool attachment; wherein the drive stud has an opening therein; wherein a locking element is movably disposed in the opening; wherein the drive stud defines a longitudinal axis and the opening is oriented at a first non-zero skew angle with respect to the longitudinal axis; wherein the opening defines upper and lower ends, the lower end of the opening being located at a portion of the drive stud constructed for insertion into the tool attachment; and wherein the lower end of the locking element is constructed to engage the tool attachment when the locking element is positioned in an engaging position and to release the tool attachment from the drive stud when the locking element is moved to a release position.

According to this invention, an actuating element is slidably positioned on the drive stud to move along the longitudinal axis. Actuating the actuating element moves the locking element from the engaging position to the release position as the actuating element moves along the longitudinal axis, and rotation of the actuating element would normally apply side loads to the locking element, unless rotation were prevented. An anti-rotation element is coupled to one of the actuating element and the drive stud to slide along an out-of-round surface defined by the other of the actuating element and the drive stud. This out-of-round surface is oriented to prevent rotation of the actuating element about the longitudinal axis, and thereby to limit side loading of the locking element.

In some embodiments, a resilient retaining member is positioned in a recess in either the actuating element or the drive stud to engage the other of the actuating element and the drive stud to limit movement of the actuating element relative to the drive stud along the longitudinal axis.

The preferred embodiments described below are unusually simple, compact, rugged and inexpensive to manufacture.

BRIEF DESCRIPTION OF THE DRAWINGS

FIG. 3 is an enlarged fragmentary longitudinal sectional view of portions of the embodiment of FIG. 1, showing the locking pin in the extended or engaging position.

FIG. 4 is a sectional view corresponding to FIG. 3 showing the locking pin in the retracted or release position.

FIG. 5 is a perspective view of a combined retaining element and anti-rotation element of a second preferred embodiment of this invention.

DETAILED DESCRIPTION OF THE PRESENTLY PREFERRED EMBODIMENTS

Figure 1:
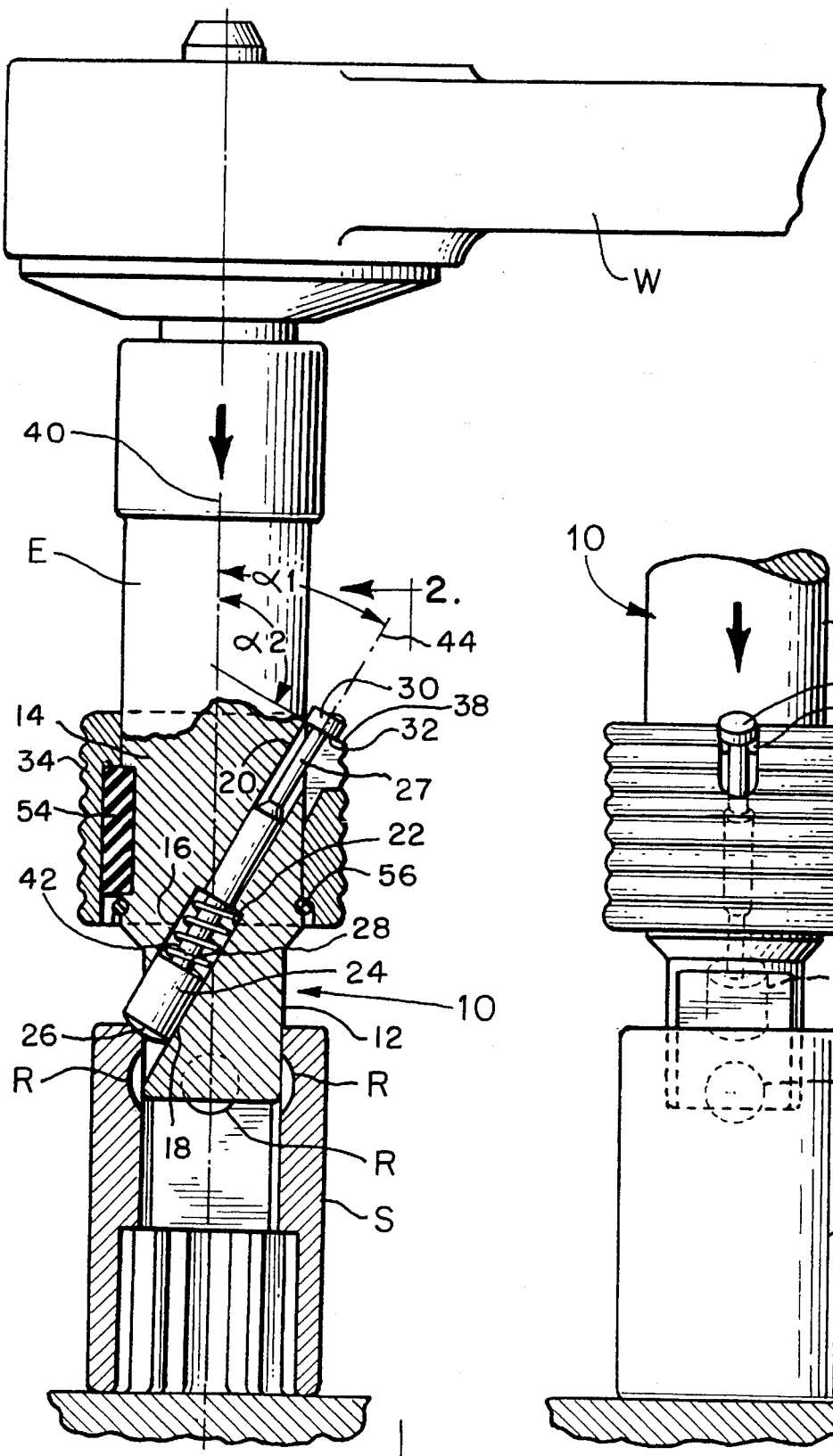
FIG. 1 is a side elevational view partially in cross section of a rachet socket wrench, an extension bar and a socket disposed for attachment to the lower end of the extension bar and showing a first presently preferred embodiment of the quick release mechanism of this invention.

Turning now to the drawings, FIG. 1 shows a side elevational view of a tool which in this preferred embodiment is an extension bar E. As shown in FIG. 1, extension bar E is designed to be mounted on a wrench W and to fit into and transmit torque to a socket S. The extension bar E terminates at its lower end in a drive stud 10 having a lower portion 12 and an upper portion 14. The lower portion 12 is constructed for insertion into the socket S, and defines an out-of-round cross section. Typically, the lower portion 12 has a square, hexagonal or other non-circular shape in horizontal cross section. The upper portion 14 will often define a circular cross section, though this is not required.

As shown in FIG. 1, the drive stud 10 is configured to define a diagonally positioned opening 16 having a lower end 18 and a upper end 20. The lower end 18 is positioned in the lower portion 12 of the drive stud 10, and the upper end 20 is positioned in the upper portion 14 of the drive stud 10. The opening 16 has a smaller diameter adjacent the upper end 20 than the lower end 18, and the opening 16 defines a transverse step 22 between the larger and smaller diameter portions of the opening 16.

The foregoing features of the wrench W, extension bar E and socket S are substantially as described in connection with FIGS. 20–25 of U.S. Pat. No. 4,848,196. It may be preferable in some embodiments to provide the opening 16 with a constant diameter, and to define the step 22 in some other manner, as for example with a plug of the type shown in FIG. 20 of my previous U.S. Pat. No. 4,848,196.

As shown in FIG. 1, a locking element such as a pin 24 is slidably positioned in the opening 16. This pin 24 defines a lower end 26 shaped to engage the socket S. The lower end 26 of the pin 24 may be conventionally rounded, or it may alternately be provided with a step as shown in U.S. Pat. No. 4,848,196 or other useful shapes. Though illustrated as a pin 24, the locking element may take various shapes, including irregular and elongated shapes. The purpose of the locking element is to hold the tool attachment in place on the drive stud during normal use, for example when pulled by a user, and the term "locking" does not imply locking the tool attachment in place against all conceivable forces tending to dislodge the tool attachment. If desired, the pin 24 may be provided with an out of round cross section and the opening 16 may define a complementary shape such that a preferred rotational position of the pin 24 in the opening 16 is automatically obtained. The pin 24 defines a reduced diameter neck 27 that terminates at one end at a step 28 and at the other at an enlarged head 30. The underside of the head 30 defines a ledge surface 32 oriented transversely to the length of the pin 24. The ledge surface 32 may be flat, convex, concave or spherical. Similarly, other shapes for the ledge surface 32 are possible so as to allow the ledge surface 32 and sliding surface 38 to cooperate with each other so as to move relative to each other without binding. Furthermore, the ledge surface 32 may be discontinuous or have a plurality of surfaces.

Figure 2:
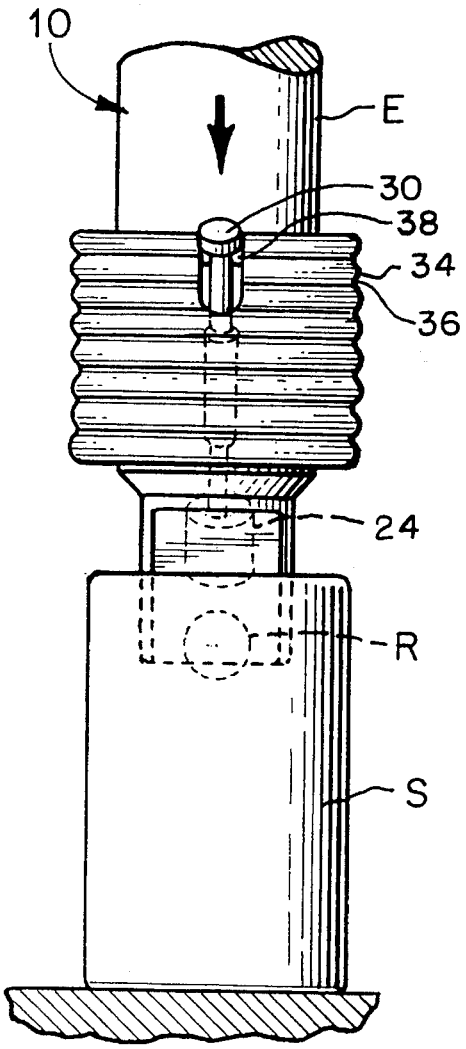
FIG. 2 is a fragmentary side elevational view taken along line 2—2 of FIG. 1.

Also as shown in FIG. 1, an actuating element such as a collar 34 is positioned around the upper portion 14 of the drive stud 10. This collar 34 defines a slot 36 and an adjacent sliding surface 38, as best shown in FIG. 2.

As best shown in FIG. 1, the drive stud 10 defines a longitudinal axis 40, and the collar 34 is guided to move along the longitudinal axis 40. The opening 16 defines an opening axis 44 which is oriented at a first non-zero acute angle $\alpha 1$ with respect to the longitudinal axis 40. The sliding surface 38 is oriented at a second non-zero skew angle $\alpha 2$ with respect to the longitudinal axis. The angles $\alpha 1$ and $\alpha 2$ preferably differ by 90°. With this arrangement, the sliding surface 38 is oriented parallel to the ledge surface 32 and transverse to the pin 24. In other embodiments, the sliding surface 38 may have other shapes, such as a discontinuous surface or a plurality of surfaces, to allow relative movement between sliding surface 38 and ledge surface 32 without binding. Thus, it is contemplated to employ all combinations of shapes for ledge surface 32 and sliding surface 38 which allow them to cooperate with each other so as to move relative to each other without binding.

A spring such as a coil spring 42 biases the pin 24 to the engaging position shown in FIG. 1. As shown, the spring 42 is an extension spring which bears between the step 22 and the step 28 in the locking pin 24, with the neck 27 passing through the spring 42. In alternate embodiments the spring may be implemented in other forms, as for example by means of a leaf spring. Furthermore, if a coil spring is used, it may be employed as either a compression or an extension spring with suitable alterations to the design of FIG. 1, and the spring may be eliminated in some embodiments. In some embodiments the step 22 is not required.

As best shown in the enlarged view of FIG. 3, the drive stud 10 defines a longitudinally extending groove 48 and a circumferentially extending recess 50. The collar 34 defines a longitudinally extending groove 52 which generally corresponds in position and dimension to the groove 48. Both the grooves 48 and 52 are generally rectangular in cross section, and are bounded by faces 49, 53 respectively. Of course, the grooves 48, 52 may be provided with any suitable cross sectional shapes.

An anti-rotation element such as a key 54 is fixed in the groove 48 by a resilient retaining element such as a C-shaped spring clip 56. The key 54 is immobilized in the circumferential direction by the faces 49 defined by the groove 48 in the drive stud 10. The key 54 is sized to provide a sliding fit in the groove 48, and the spring clip 56 engages the recess 50 to prevent the key 54 from moving longitudinally out of the groove 48. The collar 34 prevents the key 54 from moving radially outwardly out of the groove 48, and the faces 53 cooperate with the key 54 to prevent the collar 34 from rotating relative to the drive stud 10. As illustrated, the collar 34 and the locking pin 24 are coupled together in such a way that rotation of the collar 34 tends to side load the locking pin 24. By preventing rotation of the collar 34, the key 54 protects the locking pin 24 and the locking neck 27 from damage due to such side loading. As shown in FIG. 4, the key 54 accommodates longitudinal movement of the collar 34 in the longitudinal direction of the arrows of FIG. 4, because the groove 52 of the collar 34 is aligned with the longitudinal direction, and the key 54 provides a sliding fit in the groove 52.

The pin 24, the collar 34 and the spring 42 can be assembled in a straightforward manner on the drive stud 10. First the spring 42 is placed around the neck 27 of the pin 24, and this assembly is then placed in the opening 16 via the lower end 18. The pin 24 is then moved to compress the spring 42 between the step 28 on the pin 24 and the step 22 in the opening 16 until the head 30 protrudes out of the opening 16. Then the collar 34 is moved past the lower portion 12 onto the upper portion 14 of the drive stud 10, with the neck 27 passing through the slot 36, and with the ledge surface 32 sliding on the sliding surface 38. Once the collar 34 is properly seated, the key 54 is moved longitudinally in the groove 48 to the position shown in FIG. 4, and the spring clip 56 is installed in the recess 50. This completes assembly of the embodiment shown in FIGS. 1–4. Note that the spring clip 56 retains the key 54 in the groove 48, and by this action prevents both the key 54 and therefore the collar 34 from inadvertent disassembly.

It is not essential in all embodiments that the spring clip 56 and the key 54 be formed as separate elements. If desired, the spring clip 56 can be secured to the key 54, and they can even be formed of one piece as an integral unit. FIG. 5 shows a perspective view of a one-piece element 58 that includes a key portion 60 that functions as an anti-rotation element and a spring clip portion 62 that functions as a retaining element. In this embodiment the spring clip portion 62 has a rectangular section and is intended for use with a rectangular groove (not shown) in the drive stud.

The pin 24 simultaneously serves a number of separate functions. First, it releasably secures the socket S to the drive stud 10 as described below. Second, the pin 24 engages the slot 36 and thereby limits movement of the collar 34 away from the lower portion 12 of the drive stud 10. The pin 24 captures the collar 34 positively in place, and the key 54 prevents any undesired rotation of the collar 34 and associated side loading of the pin 24.

Though the actuating element is shown as a collar 34 that slides along the longitudinal axis 40, an alternate embodiment of the actuating element may be formed as a slide that does not encircle the drive stud 10.

Figure 6:
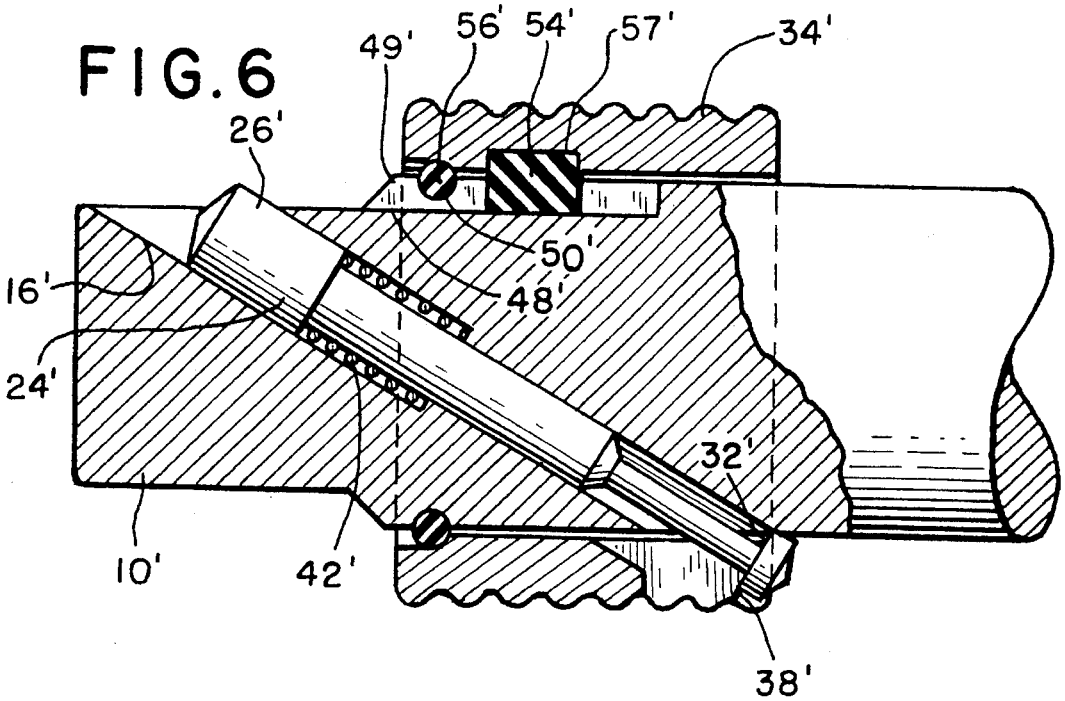
FIG. 6 is an enlarged fragmentary longitudinal sectional view of a third preferred embodiment of this invention, showing the locking pin in the extended or engaging position.
Figure 7:
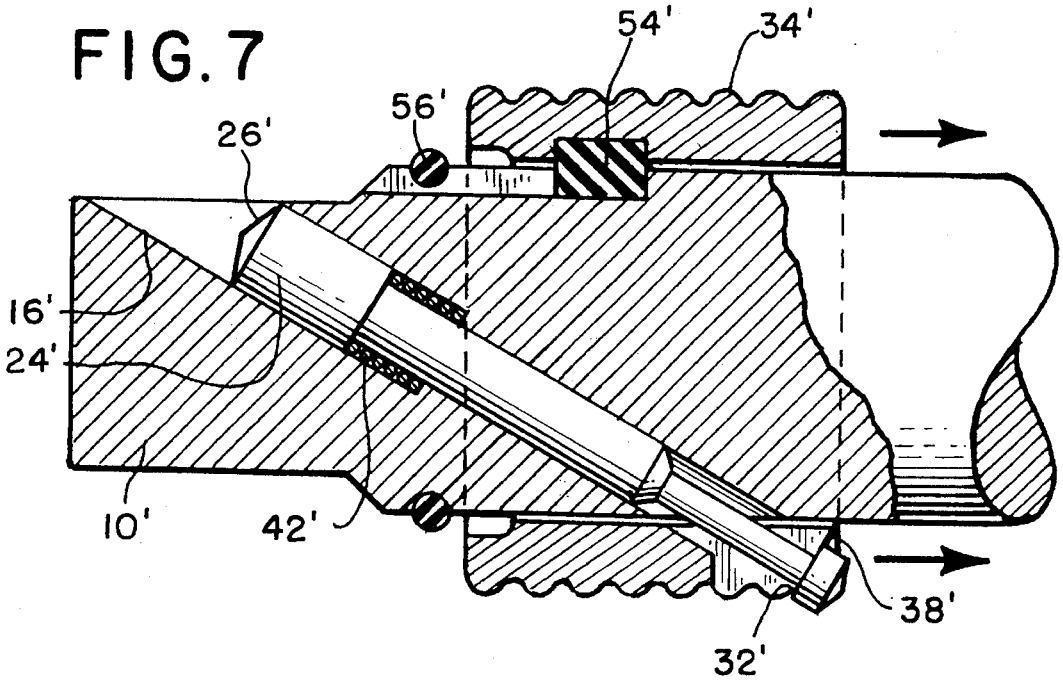
FIG. 7 is a sectional view corresponding to FIG. 6 showing the locking pin in the retracted or release position.

FIGS. 6 and 7 provide longitudinal sectional views of a third preferred embodiment of this invention, corresponding to FIGS. 3 and 4, respectively. In this third embodiment similar elements to those discussed above in conjunction with FIGS. 1 through 4 are provided with the same reference numeral, with an added prime.

As shown in FIG. 6, the drive stud 10' defines a groove 48' that is bounded by faces 49'. The drive stud 10' also defines a circumferential recess 50' that receives a retaining element or a spring clip 56' All of these features are identical to the corresponding features in the embodiment of FIGS. 3 and 4.

In contrast to the embodiment of FIGS. 3 and 4, the collar 34' is rigidly secured to an anti-rotation element or key 54'. In the examples shown in FIGS. 6 and 7, the key 54' is received in a complementary opening 57' in the collar 34', such that there is no relative movement allowed between the key 54' and the collar 34'. The key 54' can be of any desired shape, and it can be formed integrally with the collar 34'.

In this embodiment the spring clip 56' is retained in the recess 50' to prevent the collar 34' from moving excessively toward the locking pin 24'. The collar 34' rigidly secures the key 54' in place, and the key 54' fits in a sliding fit in the groove 48'. The key 54' cooperates with the faces 49' to prevent relative rotation of the collar 34' with respect to the drive stud 10'. In this way the locking pin 24' is protected from excessive side loading. Because the spring clip 56' plays no role in retaining the key 54' in the groove 48', it is not important that the spring clip 56' cross the groove 48'. A spring clip which extends over a circumferential arc of 270° or less can therefore be used.

Figure 8:
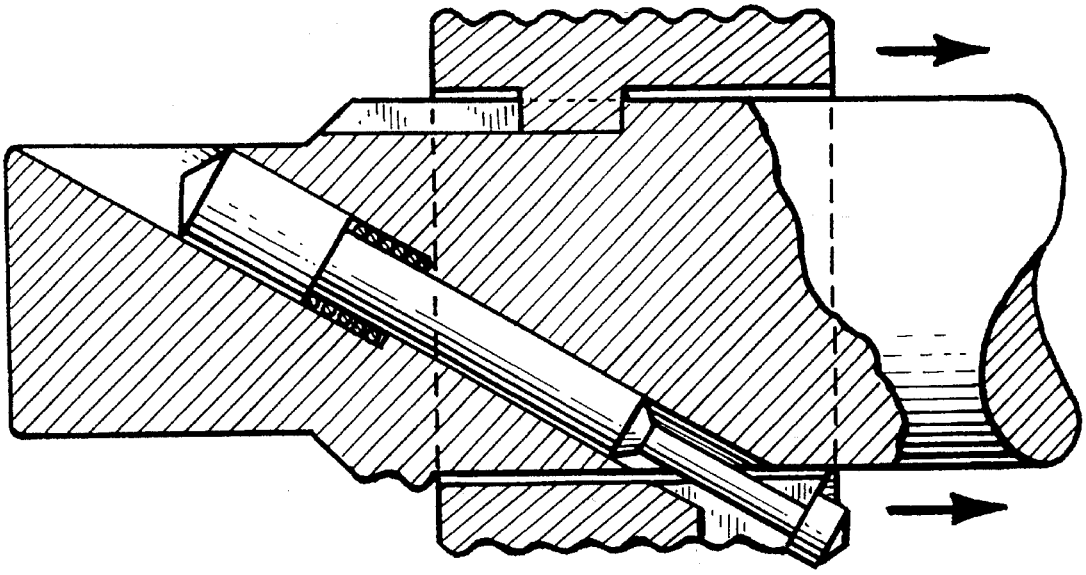
FIG. 8 is an enlarged fragmentary longitudinal sectional view of a fourth preferred embodiment of this invention, showing the locking pin in the retracted or release position.

FIG. 8 shows a fourth preferred embodiment, which differs principally from the third embodiment of FIGS. 6 and 7 in two respects. First, the key 54" is formed in one piece with the collar 34". Second, the spring clip 56' and recess 50' of FIGS. 6 and 7 have been deleted. Instead, longitudinal movement of the collar 34" to the left as shown in FIG. 8 is limited by an upset 57". The upset 57" acts as a retaining element. The term "protrusion" will be used in a broad sense in connection with elements for retaining the collar on the drive stud; this term is intended to encompass deformations such as the upset 57", retaining elements such as the spring clip 56, as well as other suitable structures.

The embodiment of FIG. 8 can be assembled in a manner similar to that described above, but there are of course fewer parts to assemble in the embodiment of FIG. 8. The upset 57" can be formed by deforming the drive stud 10" with an impact after the parts have been assembled as shown in FIG. 8.

Figure 9:
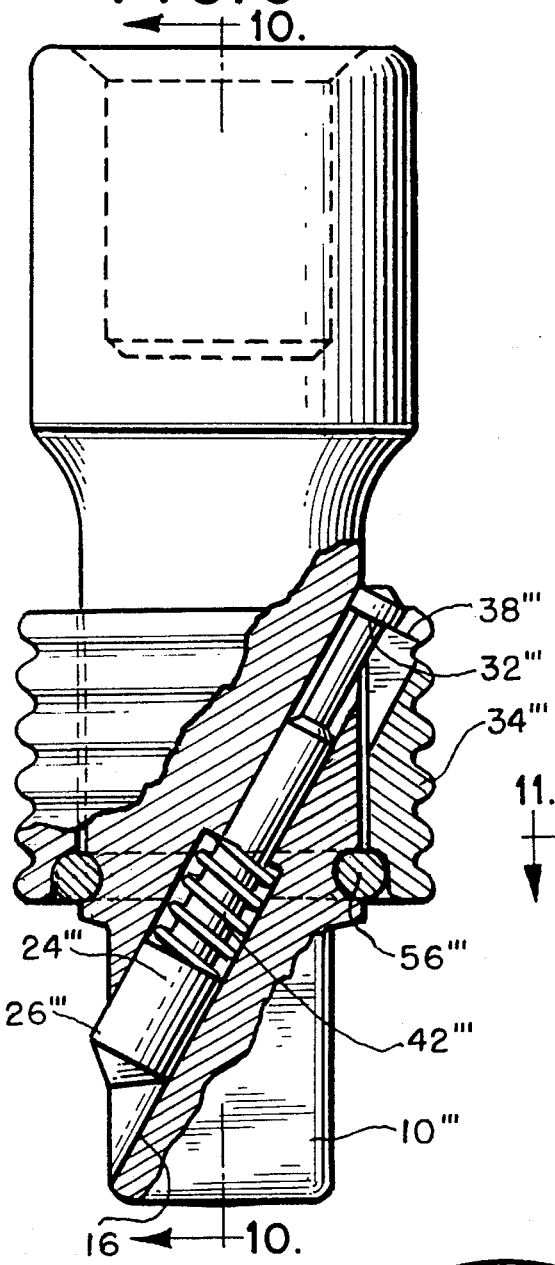
FIG. 9 is a fragmentary longitudinal sectional view of a fifth preferred embodiment of this invention.
Figure 10:
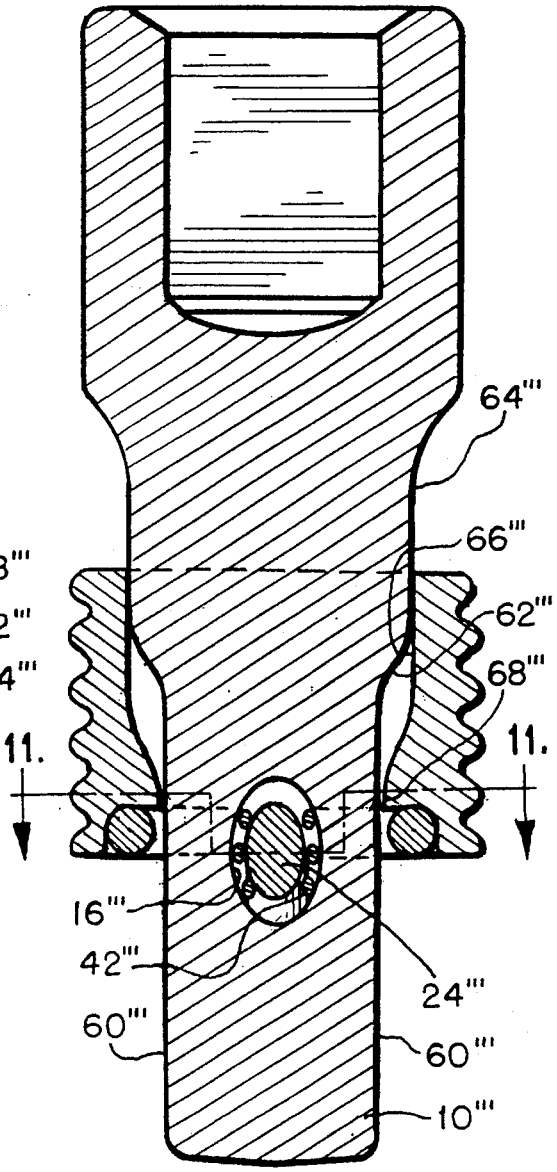
FIG. 10 is a longitudinal sectional view taken along line 10—10 of FIG. 9.
Figure 11:
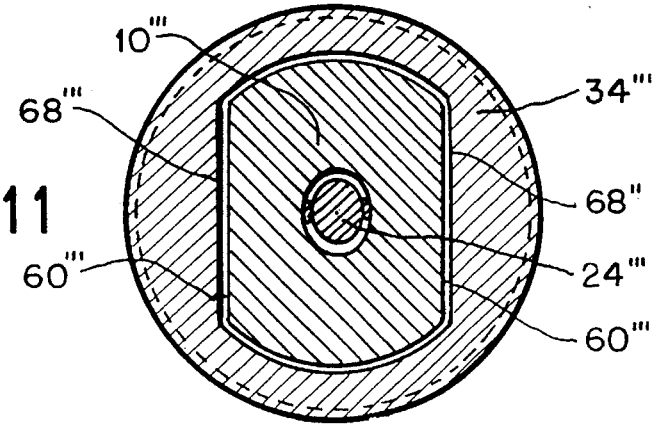
FIG. 11 is a cross-sectional view taken along line 11—11 of FIG. 10.

FIGS. 9–11 relate to a fifth preferred embodiment. In this fifth embodiment similar elements to those discussed above in conjunction with FIGS. 1–4 are provided with the same reference numeral, with an added triple prime.

As shown in FIGS. 10 and 11, the drive stud 10''' defines opposed planar faces or flats 60''' which extend to into the collar 34'''. The drive stud 10''' defines a circular cross-section in the region 64", and the reference numeral 62''' indicates the transition between the planar faces 60''' and the circular cross-section 64'''. The planar faces 60''' are out-of-round surfaces extending longitudinally along the drive stud 10''' and providing an anti-rotation function as described below. In many ways, the planar faces 60''' perform the function of the grooves 48 discussed above.

The collar 34''' defines a central opening which is circular in cross-section in the region 62''' so as to slide over the circular cross-section 64''' of the drive stud 10'''. The collar 34''' also defines two protrusions 68''' which are best shown in FIGS. 10 and 11. These protrusions 68''' define planar inwardly directed surfaces which are complimentarily shaped to the planar faces 60''', as shown in FIG. 11. The protrusions 68''' are also out-of-round, and they are shaped to slide along the planar faces 60'''.

Because both the protrusions 68''' and the planar faces 60''' are out-of-round, they perform an anti-rotation function, preventing the collar 34''' from rotating on the drive stud 10", and thereby protecting the pin 24''' from side loading as discussed above.

The embodiment of FIGS. 9–11 includes two planar faces 60''' and two protrusions 68''' oriented at 90° with respect to the plane of FIG. 9. It will, of course, be understood that a smaller or larger number of planar faces 60''' and mating protrusions 68''' can be used, and that they can be disposed at any desired angle with respect to the plane of FIG. 9.

The embodiment of FIGS. 9–11 requires a reduced number of parts as compared with certain other embodiments of the invention, and this may provide a cost saving. Additionally, the embodiment of FIGS. 9–11 may require fewer fabrication operations such as machining, as well as fewer high precision fabrication operations. This embodiment is particularly robust and easy to assemble. Since the planar faces 60''' extend to the end of the drive stud 10''', the collar 34''' can simply be inserted in place and then retained on the drive stud 10''' with the spring clip 56'''.

The operation of the quick release mechanisms described above will be apparent from FIGS. 1 through 11. The following comments focus on the embodiment of FIGS. 1–4. It will of course be understood that the other embodiments operate similarly, with the exceptions noted above. As shown in FIG. 1, when the lower portion 12 of the drive stud 10 is brought into alignment with the socket S, the lower end 26 of the locking pin 24 bears on the socket S.

Further downward movement of the drive stud 10 moves the pin 24 inwardly in the opening 16, thereby allowing the lower portion 12 to move within the socket S. This can be done without manipulating the collar 34 in any way.

When the drive stud 10 is fully seated in the socket S, the spring 42 returns the locking pin 24 to the engaging position of FIG. 3, in which the lower end 26 of the locking pin 24 engages the recess R in the socket S. The pin 24 will provide at least frictional engagement, even with a socket S which does not include a recess R.

Downward forces on the socket S are not effective to move the locking pin 24 out of its engaging position, and the socket S is positively held in place on the drive stud 10.

As shown in FIG. 4, the collar 34 is raised to release the socket S. This causes the sliding surface 38 to translate under the ledge surface 32, thereby applying a withdrawing force substantially aligned with the length of the opening 16. This withdrawing force is effective to compress the spring 42 and to move the pin 24 from the engaging position of FIG. 3 to the release position of FIG. 4. When the locking pin 24 reaches the release position the socket S is free to fall from the drive stud 10 under the force of gravity.

This invention can be adapted for use with the widest range of torque transmitting tools, including hand tools, power tools and impact tools. Simply by way of illustration, this invention can be used with socket wrenches, including those having ratchets, T-bar wrenches, and speeder wrenches, all as described and shown in U.S. Pat. No. 4,848,196. Furthermore, this invention is not limited to sockets of the type shown, but can be used with a wide range of tool attachments, including sockets or tool attachments with varying sized recesses R and even on sockets without a recess of any type.

Of course, this invention can be adapted for use with a wide variety of quick release mechanisms of the type defined in the preamble of claim 1. For example, this invention can readily be used with the quick release mechanisms shown in U.S. Pat. No. 4,848,196, and with the mechanism shown in U.S. patent application Ser. No. 07/959,215, which includes a tension member that interconnects the locking element and the actuating element.

Of course, the quick release mechanism of this invention can be used in any physical orientation, and the terms "upper", "lower" and the like have been used with reference to the orientation shown in the drawings. Furthermore, the terms "engaging position" and "release position" are each intended to encompass multiple positions within a selected range. For example, in the embodiment of FIG. 1 the exact position of the engaging position will vary with the depth of the recess R in the socket S, and the exact position of the release position may vary with a variety of factors, including the extent to which the actuating element is moved.

As suggested above, the present invention can be implemented in many ways, and this invention is not limited to the specific embodiments shown in the drawings. However, in order to define the presently preferred embodiment of this invention the following presently preferred details of construction are provided. These details are of course in no way intended to limit the scope of this invention.

By way of example, the pin 24 may be formed of a material such as a steel of moderate to mild temper, and the collar 34 may be formed of any suitable material such as brass, steel, or powdered metal. The angle $\alpha 1$ may range from about 30° to about 45° and the angle $\alpha 2$ may range from about 120° to about 135°, respectively. For a three-eighths drive wrench, the width of the sliding surface 38 may be about 0.15 inch or even larger, as long as it receives the head of the pin properly; the width of the slot 36 may be about 0.06 inch; the length of the collar 34 may be about 0.49 inch; and the outer diameter of the collar 34 may be about 0.73 inch.

From the foregoing description it should be apparent that the objects set out initially above have been achieved. In particular, the mechanism shown in the drawings is low profile with respect to the circumference of the extension bar E. The disclosed mechanism is simple to manufacture and assemble, and it requires relatively few parts. It is rugged in operation, and it automatically engages a socket as described above. Because of its design, the mechanism will accommodate various types of sockets, including sockets with various types of recesses or no recess at all. In the illustrated embodiment, the collar 34 may be gripped at any point on its circumference, and does not require the operator to use a preferred angular orientation of the tool. Furthermore, the outer circumference of the collar 34 may be shaped as shown in FIG. 2 to allow convenient manipulation of collar 34. The collar 34, 34', 34" is prevented from rotating relative to the drive stud 10, 10', 10", 10'" by the key 54, 54', 54" and the protrusions 68", respectively.

In the illustrated embodiment of FIG. 1, the sliding surface 38 is relatively narrow and confined to a region in the vicinity of the slot 36. Alternately, the sliding surface 38 may be extended laterally, resulting in a crescent shape at the end of the collar 34. Additionally, the slot 36 may extend only partly through the thickness of the collar 34 so that neither the slot 36 nor the pin 24 extends through the outer cylindrical surface of the collar 34. In another embodiment the head 30 only extends through the thickness of the collar 34 when the pin 24 is fully withdrawn from its socket holding position. In some alternate embodiments, the locking element may be configured to require a positive action on the part of the operator to retract the locking element as the drive stud is moved into the socket. Certain of these embodiments may require recesses in the sockets as described above to provide all of the functional advantages described.

In the preferred embodiment of FIG. 1, the difference between the first and second angles $\alpha 1$ and $\alpha 2$ is approximately 90°. This minimizes skew forces applied to the pin 24 and minimizes any tendency of the pin 24 to bind in the opening 16. However, if friction between the pin 24 and the walls of the opening 16 is sufficiently low, the sliding surface 38 may be positioned at a skew angle with respect to the pin 24 rather than the transverse angle illustrated.

It is intended that the foregoing detailed description be regarded as illustrative rather than limiting, and that it be understood that it is the following claims, including all equivalents, which are intended to define the scope of this invention.

We claim:

1. In a tool comprising a drive stud for receiving and releasing a tool attachment; said drive stud having an opening therein and a locking element movably disposed in the opening; said drive stud defining a longitudinal axis and the opening oriented at a first non-zero angle with respect to the longitudinal axis; said opening defining upper and lower ends, the lower end of the opening being located at a portion of the drive stud constructed for insertion into the tool attachment; said lower end of the locking element being constructed to engage the tool attachment when the locking element is positioned in an engaging position and to release the tool attachment from the drive stud when the locking element is moved to a release position; the improvement comprising:

an actuating element retained on and slidably positioned on the drive stud to move along the longitudinal axis, said actuating element defining a slot;

said actuating element receiving the locking element in the slot and coupled to the locking element to move the locking element from the engaging position to the release position as the actuating element moves along the longitudinal axis, and rotation of said actuating element being effective to apply side loads to a portion of the locking element received in the slot;

an anti-rotation element coupled to one of the actuating element and the drive stud to slide along an out-of-round surface defined by the other of the actuating element and the drive stud, said out-of-round surface oriented to prevent rotation of the actuating element about the longitudinal axis and thereby to limit side loading of the locking element.

2. In a tool comprising a drive stud for receiving and releasing a tool attachment; said drive stud having an opening therein and a locking element movably disposed in the opening; said drive stud defining a longitudinal axis and the opening oriented at a first non-zero angle with respect to the longitudinal axis; said opening defining upper and lower ends, the lower end of the opening being located at a portion of the drive stud constructed for insertion into the tool attachment; said lower end of the locking element being constructed to engage the tool attachment when the locking element is positioned in an engaging position and to release the tool attachment from the drive stud when the locking element is moved to a release position; the improvement comprising:

an actuating element retained on and slidably positioned on the drive stud to move along the longitudinal axis;

said actuating element coupled to the locking element to move the locking element from the engaging position to the release position as the actuating element moves along the longitudinal axis, and rotation of said actuating element being effective to apply side loads to the locking element;

an anti-rotation element coupled to one of the actuating element and the drive stud to slide along an out-of-round surface defined by the other of the actuating element and the drive stud, said out-of-round surface oriented to prevent rotation of the actuating element about the longitudinal axis and thereby to limit side loading of the locking element;

a protrusion on one of the drive stud and the actuating element positioned to engage the other of the drive stud and the actuating element to limit movement of the actuating element relative to the drive stud toward the portion of the drive stud constructed for insertion into the tool attachment;

said actuating element shaped to slide onto the drive stud with the locking element disposed in the opening, past the portion of the drive stud constructed for insertion into the tool attachment, and into engagement with the locking element prior to formation of the protrusion.

3. The invention of claim 1 or 2 wherein the out-of-round surface comprises at least one flat on the drive stud.

4. The invention of claim 1 or 2 wherein the out-of-round surface comprises a groove defined by the drive stud.

5. The invention of claim 1 or 2 wherein the out-of-round surface comprises a groove defined by the actuating element.

6. The invention of claim 1 or 2 wherein said locking element defines a ledge surface; and wherein said actuating element defines a sliding surface positioned to engage the ledge surface, said sliding surface oriented at a second angle with respect to the longitudinal axis such that movement of the actuating element along the longitudinal axis in a selected direction causes the ledge surface to slide along the sliding surface, thereby moving the locking element in the opening from the engaging to the release positions.

7. The invention of claim 1 or 2 wherein said actuating element comprises a collar positioned around the drive stud.

8. The invention of claims 1 or 2 wherein the out-of-round surface is defined by the drive stud and extends continuously to a portion of the drive stud constructed for insertion into the tool attachment.

9. The invention of claim 1 or 2 wherein the out-of-round surface is defined by the actuating element and extends continuously to an edge of the actuating element adjacent to the portion of the drive stud constructed for insertion into the tool attachment.

10. The invention of claim 2 wherein the protrusion comprises a resilient retaining element positioned in a recess in the drive stud to engage the actuating element to limit movement of the actuating element relative to the drive stud along the longitudinal axis.

11. The invention of claim 10 wherein the out-of-round surface comprises a groove defined by the actuating element, and wherein the retaining element holds the anti-rotation element in position on the drive stud.

12. The invention of claim 10 or 11 wherein the anti-rotation element is secured to the retaining element.

13. The invention of claim 12 wherein the anti-rotation element is formed in one piece with the retaining element.

14. The invention of claim 10 wherein the recess extends at least partly around the drive stud.

15. The invention of claim 10 wherein the retaining element comprises a spring clip.

16. In a tool comprising a drive stud for receiving and releasing a tool attachment; said drive stud having an opening therein and a locking element movably disposed in the opening; said drive stud defining a longitudinal axis and the opening oriented at a first non-zero angle with respect to the longitudinal axis; said opening defining upper and lower ends, the lower end of the opening being located at a portion of the drive stud constructed for insertion into the tool attachment; said lower end of the locking element being constructed to engage the tool attachment when the locking element is positioned in an engaging position and to release the tool attachment from the drive stud when the locking element is moved to a release position; the improvement comprising:

an actuating element retained on and slidably positioned on the drive stud to move along the longitudinal axis, said actuating element defining a slot;

said actuating element receiving the locking element in the slot and coupled to the locking element to move the locking element from the engaging position to the release position as the actuating element moves along the longitudinal axis, and rotation of said actuating element being effective to apply side loads to a portion of the locking element received in the slot;

an anti-rotation element positioned between the actuating element and the drive stud to slide in a groove defined by one of the actuating element and the drive stud, said groove oriented to prevent rotation of the actuating element about the longitudinal axis and thereby to limit side loading of the locking element.

17. In a tool comprising a drive stud for receiving and releasing a tool attachment; said drive stud having an opening therein and a locking element movably disposed in the opening; said drive stud defining a longitudinal axis and the opening oriented at a first non-zero angle with respect to the longitudinal axis; said opening defining upper and lower ends, the lower end of the opening being located at a portion of the drive stud constructed for insertion into the tool attachment; said lower end of the locking element being constructed to engage the tool attachment when the locking element is positioned in an engaging position and to release the tool attachment from the drive stud when the locking element is moved to a release position; the improvement comprising:

an actuating element retained on and slidably positioned on the drive stud to move along the longitudinal axis;

said actuating element coupled to the locking element to move the locking element from the engaging position to the release position as the actuating element moves along the longitudinal axis, and rotation of said actuating element being effective to apply side loads to the locking element;

an anti-rotation element positioned between the actuating element and the drive stud to slide in a groove defined by one of the actuating element and the drive stud, said groove oriented to prevent rotation of the actuating element about the longitudinal axis and thereby to limit side loading of the locking element;

a protrusion on one of the drive stud and the actuating element positioned to engage the other of the drive stud and the actuating element to limit movement of the actuating element relative to the drive stud toward the portion of the drive stud constructed for insertion into the tool attachment;

said actuating element shaped to slide onto the drive stud with the locking element disposed in the opening, past the portion of the drive stud constructed for insertion into the tool attachment, and into engagement with the locking element prior to formation of the protrusion.

* * * * *

UNITED STATES PATENT AND TRADEMARK OFFICE

CERTIFICATE OF CORRECTION

PATENT NO. : 5,501,125
DATED : March 26, 1996
INVENTOR(S) : Peter M. Roberts et al.

It is certified that error appears in the above-indentified patent and that said Letters Patent is hereby corrected as shown below:

On the Title Page

In Column 2, under "FOREIGN PATENT DOCUMENTS", add

--936299 7/1994 Mexico.
NI-64004 2/1994 Taiwan.
5-254390 7/1994 Japan.
2107858 4/1994 Canada.--

Signed and Sealed this

Fifth Day of August, 1997

Bruce Lehman

*Attest:*

BRUCE LEHMAN

*Attesting Officer*

*Commissioner of Patents and Trademarks*